US006266929B1

(12) United States Patent
Cline

(10) Patent No.: US 6,266,929 B1
(45) Date of Patent: Jul. 31, 2001

(54) SNOW GUARD

(76) Inventor: Roger M. Cline, P.O. Box 126, Bluemont, VA (US) 22012

( * ) Notice: Subject to any disclaimer, the term of this patent is extended or adjusted under 35 U.S.C. 154(b) by 176 days.

(21) Appl. No.: 08/813,359

(22) Filed: Mar. 7, 1997

(51) Int. Cl.[7] ..... E04D 13/10
(52) U.S. Cl. ..... 52/24; 52/98; D8/499
(58) Field of Search ..... 52/24, 25, 26, 52/98, 100, 745.21; D8/499

(56) References Cited

U.S. PATENT DOCUMENTS

| | | | | |
|---|---|---|---|---|
| D. 254,051 | * | 1/1980 | Zaleski | 52/24 X |
| D. 314,506 | * | 2/1991 | McMullen | D8/499 |
| D. 364,556 | * | 11/1995 | Lee et al. | D8/499 |
| 4,141,182 | | 2/1979 | McMullen . | |
| 5,044,130 | * | 9/1991 | Chiddister | 52/26 X |
| 5,349,791 | * | 9/1994 | Zaleski | 52/24 |
| 5,570,557 | * | 11/1996 | Kwiatkowski et al. | 52/26 X |

* cited by examiner

*Primary Examiner*—Michael Safavi
*Assistant Examiner*—Kevin D. Wilkens
(74) *Attorney, Agent, or Firm*—James Creighton Wray; Meera P. Narasimhan

(57) ABSTRACT

A one-piece, lightweight snow guard is made of clear plastic. The snow guard includes a base having a bottom and a top, a plate having a front wall and a back wall and extending upward from the top of the base, and support members having first edges connected to the top of the base and second edges connected to the front or back wall of the plate. The snow guard is preferably made of polycarbonate. The bottom of the base is connected to a roof using an adhesive. Preferably, the base includes lower side portions, a raised middle portion and upward and inward sloping portions connecting the middle portion to the side portions. The middle and sloping portions define a region for receiving a roof rib. Breakaway baffles extend from the bottom of the middle portion for retaining adhesive underneath the base. The baffles break away before adhesive application when the base is positioned over a rib. The bottom surfaces of the side portions include multiple spaced vents for venting gases through molecular interstices and for increasing physical interengagement of adhesive-bonded surface area. Preferably, the snow guard includes three support members. A first support member projects from an approximate middle of the base and extends from the front wall of the plate toward a front of the base. Second and third support members are positioned about a quarter of the way in from opposite side edges of the base and extend rearward from the back wall of the plate.

17 Claims, 2 Drawing Sheets

SNOW GUARD

BACKGROUND OF THE INVENTION

The present invention relates to apparatus for preventing large sheets of ice or snow from sliding or falling from roofs, harming persons or objects below.

Existing snow guards are attached to surfaces of sloped roofs of buildings using adhesives and through fasteners, such as screws. When through fasteners are used, holes formed in the roof promote water entry and destruction of the roof and its underlying support surface. Adhesives, when applied to connecting surfaces of existing snow guards, may fail after installation. Needs exist for snow guards having connecting surfaces that provide for long term adhesive attachment.

Snow guards are typically configured to attach to either flat roof surfaces or to seams of roofs. Some roofs have stiffening ribs or strengthening ribs at intervals that run up and down the roofs. Needs exist for universal snow guards that may be effectively positioned and connected to flat surfaces and to roofs having raised ribs.

Building owners demand snow guards that are cost effective, that is, snow guards having low costs and high lifetimes. Owners also prefer snow guards that do not detract from the architectural beauty of the buildings. Needs exist for snow guards that address those user preferences.

SUMMARY OF THE INVENTION

The present invention is a one-piece, lightweight snow guard made of clear plastic. The snow guard includes a base having a bottom and a top. A plate having a front wall and a back wall extends upward from the top of the base. Support members have first edges connected to the top of the base and second edges connected to the front or back wall of the plate. The snow guard is preferably made of polycarbonate. The bottom of the base is connected to a roof using an adhesive. Preferably, the base includes lower side portions, a raised middle portion and upward and inward sloping portions connecting the middle portion to the side portions. The middle and sloping portions define a region for receiving a roof rib and adhesive. Breakaway baffles extend from the bottom of the middle portion for retaining adhesive underneath the base. The baffles breakaway before the channel is filled with adhesive and the base is positioned over a seam. The bottom surfaces of the side portions include multiple spaced vents for venting gases and for increasing adhesive-bonded surface area. Preferably, the snow guard includes three support members. A first support member projects from an approximate middle of the base and extends from the font wall of the plate toward a front of the base. Second and third support members are positioned about a quarter of the way in from opposite side edges of the top surface of the base and extend to the back wall of the plate.

The present snow guard is made of a lightweight and durable plastic and is preferably transparent. Only adhesive is required to mount the snow guard on a roof surface. Vent channels are provided in the bottom surface of the base. Those vents allow any gases that are trapped between the bottom surface of the base and the roof surface to escape. Thus, the present invention provides for outgassing, which greatly facilitates the curing of the adhesive. The vents provide increased bonding surface area and create tractor tire like patterns in the cured adhesive, further improving the strength of the attachment.

The present snow guard may be used on flat roof surfaces or may be attached to roof stiffening ribs. The base of the snow guard includes a raised longitudinal channel for receiving adhesive and a roof rib. Breakaway baffles extend from the bottom surface of the base across the channel. For attaching the snow guard to a flat roof surface, the baffles remain in place when adhesive is provided in the channel. As the base is pressed against the roof surface, the baffles prevent the adhesive from sagging out of the ends of the base through the raised channel before the adhesive becomes fully cured. Gases formed on curing are allowed to exit the region between the base and the roof surface through interstitial spaces in the adhesive within the vents. To attach the snow guard to a roof stiffening rib, the baffles are removed or oriented upward, thereby allowing the channel of the base to receive the roof rib, with the lower side portions of the base extending along the flat roof surfaces adjacent the raised rib. Gases exit through the vents provided in the lower side portion of the bottom surface of the base.

A snow guard apparatus includes a base having a top surface and a bottom surface. A plate extends from the top surface of the base. Support members have lower edges integrally attached to the top surface of the base and inner edges integrally attached to the plate. The base further includes multiple vents provided in the bottom surface of the base. The vents extend inward from side edges of the base.

In preferred embodiments, the base includes a central, elevated, longitudinal, rib-receiving channel. The base has low side portions, an elevated middle portion, and upward and inward sloping portions extending from the low side portions to the elevated middle portion. The sloping portions and middle portion define the rib-receiving channel. The vents are provided in the bottom surface of the side portions and terminate where the sloping portions meet the side portions. Baffles extend from the bottom surface of the middle portion. The baffles are removably or movably connected to the bottom surface of the middle portion.

The snow stop plate is integrally attached to the top surface of the base and extends generally perpendicularly from the base. The plate has a front wall, a back wall, a top extending between upper edges of the front wall and the back wall, and sides extending between side edges of the front wall and the back wall. The sides slope upward and inward from the top surface of the base to the top of the plate. Preferably, the plate gradually decreases in thickness as the plate extends upward from the top surface of the base.

The support members preferably include a first support member having an inner edge integrally attached to the front wall of the plate, a second support member having an inner edge integrally attached to the back wall of the plate, and a third support member having an inner edge integrally attached to the back wall. All three members have outer edges sloping downward and outward from the plate to the top surface of the base. In preferred embodiments, the first member extends from approximately a center of the front wall. The second member extends from a region of the back wall near a left side of the plate, and the third member extends from a region of the back wall near a right side of the plate. The plate preferably extends upward between the sides of the base near the front end of the base.

The base, the plate and the support members are made of plastic and are molded as a one-piece structure. Preferably, the plastic is a transparent plastic. In preferred embodiments, the plastic is polycarbonate.

A method for preventing snow and ice from falling from roofs includes the steps of providing multiple snow guards and adhesively attaching the snow guards to a roof surface.

Attaching the snow guards further comprises applying adhesive in the channel and to the bottom surface of the base, pressing the bottom surface of the base against the roof surface, and allowing gas to exit from between the roof surface and the lower surface of the base through the vents. When rib-receiving channels are provided and the snow guard is to be attached to a flat roof surface, adhesively attaching the snow guards further includes filling the rib-receiving channel and coating the underside of the base with adhesive, placing the bottom surface of the base on the flat roof surface, and preventing adhesive from exiting ends of the base by providing baffles extending from the bottom surface of the middle portion. For attachment on a roof with strengthening ribs, the step of adhesively attaching the snow guard further includes removing the baffles and placing the rib-receiving channel over a seam in the roof surface.

These and further and other objects and features of the invention are apparent in the disclosure, which includes the above and ongoing written specification, with the claims and the drawings.

DETAILED DESCRIPTION OF THE PREFERRED EMBODIMENTS

Figure 1:
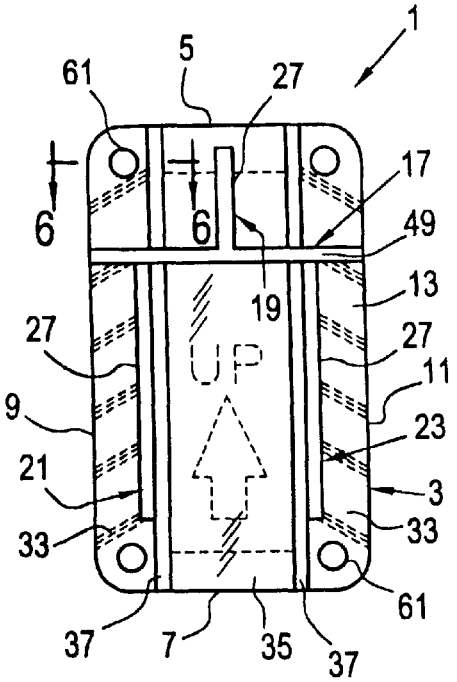
FIG. 1 is a top plan view of the snow guard.
Figure 2:
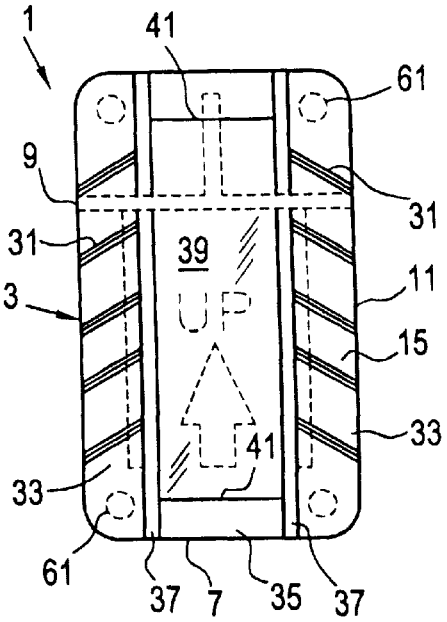
FIG. 2 is a bottom view of the snow guard.
Figure 3:
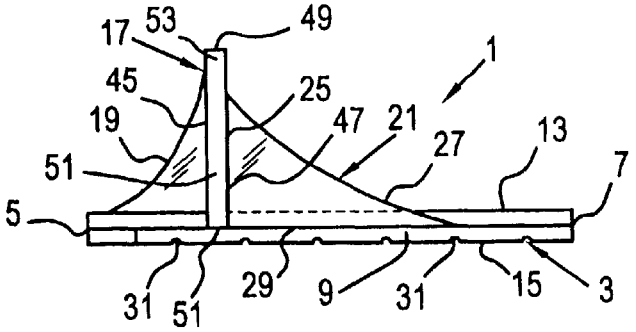
FIG. 3 is a right side elevation of the snow guard, the side opposite being a mirror image of the side shown.

As shown in FIGS. 1–3, the present invention is a one-piece, molded snow guard 1. The snow guard 1 includes a base 3 having a front end 5, a back end 7, sides 9, 11, a top surface 13 and a bottom surface 15. A snow stop plate 17 extends from the top surface 13 of the base 3 between the sides 9, 11. Preferably, the plate 17 is generally perpendicular to the base 3 and is positioned closer to the front end 5 than to the back end 7. Support members 19, 21, 23 are provided on opposite sides of the plate 17 for providing the snow guard 1 with strength and integrity. The support members 19, 21, 23 are preferably three-sided structures having inner edges 25, outer edges 27 and lower edges 29. Lower edges 29 of the support members 19, 21, 23 are integrally attached to the top surface 13 of the base 3. Inner edges 25 of the support members 19, 21, 23 are integrally attached to the plate 17. Outer edges 27 are curved, preferably in concave radii.

As shown in FIGS. 2 and 3, vents 31 are provided in the bottom surface 15 of the base 3. The vents 31 extend inward from the side edges 9, 11 and terminate at a central region. The vents 31 may be triangular-shaped, as shown in FIGS. 2 and 3, or may have any other acceptable shape or size.

As best shown in FIGS. 2 and 4–6, the base 3 preferably has low side portions 33, a raised middle portion 35, and upward and inward sloping portions 37 extending between edges of the middle portion 35 and the side portions 33. The sloping portions 37 and the middle portion 35 define a channel 39 for receiving a roof stiffening rib. The dimensions and slopes of the base 3 are preferably such that the channel 39 snugly receives standard metal roof ribs with the low side portions 33 of the base 3 extending along the flat roof surfaces adjacent the seams. As shown in FIG. 2, vents 31 are preferably only provided along the bottom surface 15 of the side portions 33. The vents 31 extend inward from the side edges 9, 11 of the base 3 and open where the sloping portions 37 meet the side portions 33. That allows for gases present in the channel 39 to be evacuated during adhesive curing and outgassing.

Figure 4:
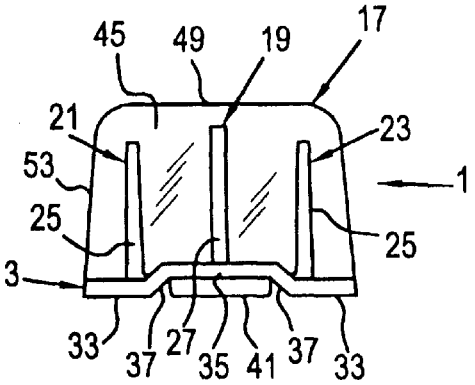
FIG. 4 is a front elevation of the snow guard.
Figure 5:
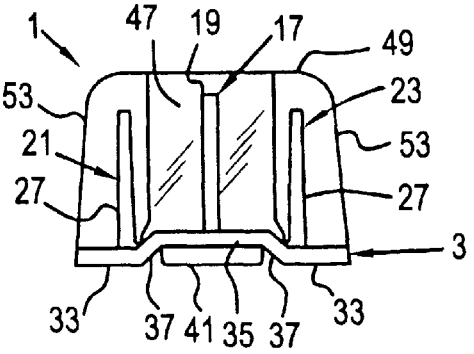
FIG. 5 is a rear elevation of the snow guard.
Figure 6:
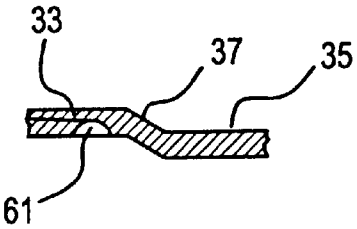
FIG. 6 is a cross-sectional detail of FIG. 1 along line A—A.

FIGS. 2 and 4–5 show a pair of baffles 41 extending downward from the middle portion 35 of the base 3. The baffles 41, which are positioned proximate opposite ends 5, 7 of the base 3, extend across the channel 39 and prevent adhesive from creeping out from beneath the base 3 through the ends 5, 7. The lower edge of each baffle 41 preferably lies in the same horizontal plane as the bottom surfaces 15 of the side portions 33.

FIGS. 1 and 3–5 show the plate 17 extending from the top surface 13 of the base 3. The plate 17 extends between the sides 9, 11 of the plate 17 and is preferably positioned near the front end 5 of the base 3. The plate 17 has a front wall 45, a back wall 47, a top 49, a bottom 51 integrally attached to the base 3, and sides 53. The front wall 45 and the back wall 47 are generally flat. As seen in FIG. 3, plate 17 may have decreasing thickness between the bottom 51 and the top 49. As shown in FIGS. 4 and 5, the top 49 of the plate 17 is also preferably flat, with the sides 53 sloping upward and inward from the base 3 to the top 49.

The present snow guard 1 includes multiple support members 19, 21, 23. As shown in FIGS. 1 and 3–5, the snow guard 1 preferably includes a first support member 19 having its inner edge 25 integrally attached to the front wall 45 of the plate 3. A second support member 21 has its inner edge 25 integrally attached to the back wall 47 of the plate 3. A third support member 23 has its inner edge 25 integrally attached to the back wall 47 of the plate 3. Lower edges 29 of the support members 19, 21, 23 are integrally attached to the top surface 13 of the base 3. The support members 19, 21, 23 are preferably positioned such that the first member 19 extends from approximately a center of the front wall 45, the second member 21 extends from a region of the back wall 47 near a left side of the plate 17, and the third member 23 extends from a region of the back wall 47 near a right side of the plate 17. When the base 3 includes a raised channel 39, the lower edge 29 of the first member 19 proceeds along a center of the middle portion towards an upward end of the base 3. The second member 21 and the third member 23 straddle the raised channel 39, with their lower edges 29 extending along the top surfaces 13 of the low side portions 33 of the base 3 toward a downward end of the base 3.

Each support member 19, 21, 23 preferably has an outer edge 27 that slopes downward from the wall 45 or 47 of the plate 17 to the top surface 13 of the base 3. The radius of curvature for the outer edge 27 for support member 19 extending from the front wall 45 is preferably greater than the radius of curvature for the outer edges 27 of support members 21, 23, extending rearward from the back wall 47 of the plate 17.

The number, size, shape, position and thickness of the support members may be adjusted and embodiments including such alterations are considered under the scope of the present invention.

The wall thickness of the snow guard may be constant for all elements of the apparatus or may vary according operational and economic demands.

Countersinks 61 may also be provided in the top surface of the base. The countersinks 61 do not extend through the base 3 but may be drilled through for securing the base 3 to a roof surface using through fasteners.

Figure 7:
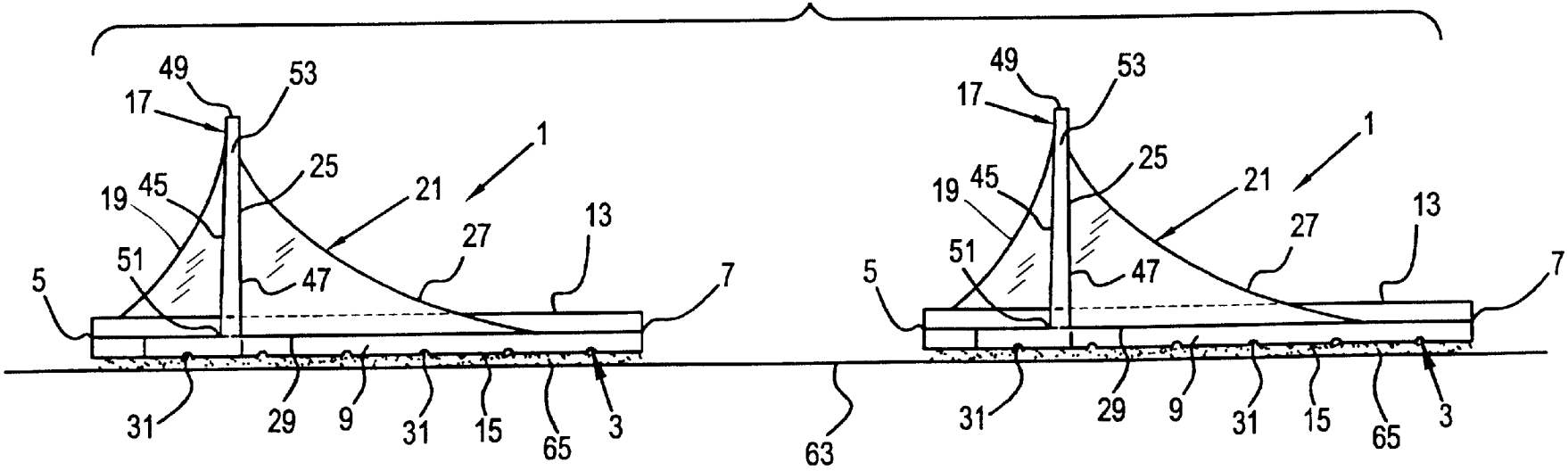
FIG. 7 shows a side elevation of snow guards mounted on a surface.

As seen in FIG. 7, when installing the present snow guard 1 on a flat roof 63 a worker fills the channel 39 and fills the bottom surfaces 15 of the base 3 and the baffles 41 with a flowable adhesive 65 such as SHUR GUARD from a gun. Using the wide cut tip or a towel or stick, the worker smooths the adhesive. The coated snow guard 1 is then pressed into place against the roof. When installing the snow guard 1 on a roof with trapezoidal or other stiffening ribs, the worker breaks the baffle 41 away from the channels 39 with his fingers, a hammer or a tool. The worker then partially fills the edges of the channel 39 and coats the channel 39 and bottom surfaces 15 with the adhesive. The worker centers the snow guard 1 into place. In both cases, while pressing the guard into place, adhesive may flow straight out of the vents 31 beyond the side edges 9, 11 of the guard 1. The worker removes the excess ahesive and forms a bead around the entire edges of the snow guard 1.

While the invention has been described with reference to specific embodiments, modifications and variations of the invention may be constructed without departing from the scope of the invention, which is defined in the following claims.

I claim:

1. A snow guard apparatus comprising a base having a top surface and a bottom surface, a plate extending from the top surface of the base and support members having lower edges integrally attached to the top surface of the base and inner edges integrally attached to the plate, wherein the base further comprises multiple vents provided in the bottom surface of the base and extending inward from side edges of the base, wherein the base further comprises an elevated, longitudinal, rib-receiving channel.

2. The apparatus of claim 1, wherein the base has sides, an upward end and a downward end, wherein the plate extends upward between the sides of the base, and wherein the plate extends from the top surface of the base near the upward end.

3. The apparatus of claim 1, wherein the base further comprises low side portions, an elevated middle portion, and upward and inward sloping portions extending from the low side portions to the elevated middle portion, with the sloping portions and middle portion defining the rib-receiving channel.

4. The apparatus of claim 3, wherein the vents are provided in the bottom surface of the side portions and open where the sloping portions meet the side portions.

5. The apparatus of claim 3, further comprising baffles extending from the bottom surface of the middle portion, wherein the baffles are removably connected to the bottom surface of the middle portion.

6. The apparatus of claim 1, wherein the plate is integrally attached to the top surface of the base and extends generally perpendicularly from the base.

7. The apparatus of claim 6, wherein the plate has a front wall, a back wall, a top extending between upper edges of the front wall and the back wall, and sides extending between side edges of the front wall and the back wall, and wherein the sides slope upward and inward from the top surface of the base to the top of the plate.

8. The apparatus of claim 7, wherein the plate gradually decreases in thickness as the plate extends upward from the top surface of the base.

9. The apparatus of claim 1, wherein the plate has a front wall and a back wall, and wherein the support members further comprise a first support member having an inner edge integrally attached to the front wall of the plate, a second support member having an inner edge integrally attached to the back wall of the plate, and a third support member having an inner edge integrally attached to the back wall.

10. The apparatus of claim 9, wherein the first member, the second member and the third member have outer edges sloping downward and outward from the plate to the top surface of the base.

11. The apparatus of claim 9, wherein the first member extends from approximately a center of the front wall, wherein the second member extends from a region of the front wall near a left side of the plate, and wherein the third member extends from a region of the front wall near a right side of the plate.

12. The apparatus of claim 1, wherein the base, plate and support member are made of plastic and are molded as a one-piece structure.

13. The apparatus of claim 12, wherein the plastic is a transparent plastic.

14. The apparatus of claim 12, wherein the plastic is polycarbonate.

15. A one-piece, molded plastic snow guard comprising a base having a front end, a back end, a left side, a right side, a top surface and a bottom surface, a plate extending from the top surface of the base and support members having lower edges integrally attached to the top surface of the base and inner edges integrally attached to the plate, wherein the base further comprises low side portions, an elevated middle portion, upward and inward sloping portions extending from the low side portions to the elevated middle portion, with the sloping portions and middle portion defining a rib-receiving channel, multiple vents provided in the bottom surface of the side portions, extending from side edges of the base and open inward where the sloping portions meet the side portions, and baffles extending from and removably connected to bottom surface of the middle portion of the base, wherein the plate extends generally perpendicularly upward between the sides of the base from the top surface of the base near the front end and has a front wall and a back wall, and wherein the support members further comprise a first support member having an inner edge integrally attached to the front wall of the plate, a second support member having an inner edge integrally attached to the back wall of the plate, and a third support member having an inner edge integrally attached to the back wall, with the first member extending from approximately a center of the front wall, the second member extending from a region of the back wall near a left side of the plate, and with the third member extending from a region of the back wall near a right side of the plate.

16. A method for preventing snow and ice from falling from roots comprising providing multiple snow guards and adhesively attaching the snow guards to a roof surface, wherein each snow guard further comprises a base having a top surface and a bottom surface, a plate extending generally perpendicularly from the top surface of the base and support members having lower edges integrally attached to the top surface of the base and inner edges integrally attached to the plate, wherein the base further comprises multiple vents provided in the bottom surface of the base and extending inward from side edges of the base, and wherein adhesively attaching the snow guards further comprises applying adhesive to the bottom surface of the base, pressing the bottom surface of the base against the roof surface, and allowing gas to exit from between the roof surface and the lower surface of the base through the vents, wherein each snow guard further comprises low side portions, an elevated middle portion, and upward and inward sloping portions extending from the low side portions to the elevated middle portion, with the sloping portions and middle portion defining a rib-receiving channel, wherein the vents are provided in the bottom surface of the side portions and terminate where the sloping portions meet the side portions, and wherein adhesively attaching the snow guards further comprises applying adhesive in the rib-receiving channel, placing the bottom surface of the base on a flat roof surface, and preventing adhesive from exiting ends of the base by providing baffles extending from the bottom surface of the middle portion.

17. The method of claim 16, wherein adhesively attaching further comprises removing the baffles before applying adhesive in the channel and on the bottom surface and placing the rib-receiving channel over a rib in the roof surface.

* * * * *